United States Patent [19]

Uhlig

[11] Patent Number: 4,878,595

[45] Date of Patent: Nov. 7, 1989

[54] TAMPER RESISTANT WIDE MOUTH PACKAGE WITH LABYRINTH SEAL

[75] Inventor: Albert R. Uhlig, Toledo, Ohio

[73] Assignee: Plastic Technologies, Inc., Toledo, Ohio

[21] Appl. No.: 204,574

[22] Filed: Jun. 9, 1988

[51] Int. Cl.[4] ..... B65D 41/18

[52] U.S. Cl. ..... 220/306; 206/807

[58] Field of Search ..... 220/306, 307; 206/807; 215/230, 250, 256, 228

[56] References Cited

U.S. PATENT DOCUMENTS

| | | | |
|---|---|---|---|
| 2,738,090 | 3/1956 | Davis . | |
| 3,463,341 | 8/1969 | Fields . | |
| 3,470,930 | 10/1969 | Jurczenia | 220/306 X |
| 3,504,818 | 4/1970 | Crisci et al. . | |
| 3,812,994 | 5/1974 | Feldman | 215/256 |
| 3,904,061 | 9/1975 | Keeler | 215/252 |
| 3,904,062 | 9/1975 | Grussen | 215/252 |
| 4,007,851 | 2/1977 | Walker | 215/307 |
| 4,024,976 | 5/1977 | Acton | 220/306 X |
| 4,027,775 | 6/1977 | Mygatt, Jr. et al. | 220/306 X |
| 4,111,329 | 9/1978 | Lampman | 220/306 X |
| 4,165,020 | 8/1979 | Hoselton | 220/306 |
| 4,197,955 | 4/1980 | Luenser | 215/252 |
| 4,215,793 | 8/1980 | Packard | 220/270 |
| 4,285,442 | 8/1981 | Wedzik | 220/270 |
| 4,322,009 | 3/1982 | Mumford | 215/253 |
| 4,322,011 | 3/1982 | Mumford | 215/270 |
| 4,355,730 | 10/1982 | Wiedmer | 215/253 |
| 4,380,304 | 4/1983 | Anderson | 220/306 |
| 4,418,833 | 12/1983 | Landis | 220/306 |
| 4,422,559 | 12/1983 | Landis | 220/306 |
| 4,431,326 | 2/1984 | Braithwaite et al. | 220/306 X |
| 4,445,622 | 5/1984 | Sideri | 220/306 |
| 4,449,640 | 5/1984 | Finkelstein | 220/306 X |
| 4,449,641 | 5/1984 | Jorgensen et al. | 220/306 |
| 4,454,956 | 6/1984 | Patterson | 220/214 |
| 4,474,305 | 10/1984 | Marco | 220/307 |
| 4,524,882 | 6/1985 | Bvc | 220/306 |
| 4,538,774 | 9/1985 | Jacobs | 220/306 |
| 4,561,562 | 12/1985 | Trombly | 220/306 |
| 4,576,298 | 3/1986 | Boik | 215/252 |
| 4,640,435 | 2/1987 | Dutt | 220/306 X |
| 4,708,259 | 11/1987 | Olimpio | 220/306 |
| 4,721,210 | 1/1988 | Lawrence | 220/306 X |
| 4,762,248 | 8/1988 | Uhlig | 220/306 X |
| 4,787,530 | 11/1988 | Edwards | 220/306 X |

FOREIGN PATENT DOCUMENTS

| | | |
|---|---|---|
| 0008190 | 2/1980 | European Pat. Off. . |
| 0055191 | 6/1982 | European Pat. Off. . |
| 1507539 | 4/1978 | United Kingdom . |

*Primary Examiner*—John Rivell

*Attorney, Agent, or Firm*—Marshall & Melhorn

[57] ABSTRACT

A closure including a container having a side wall with an attached closed end and an open end and a closure for closing the open end. The side wall of the container includes an inner wall and an outer wall at the open end and the closure includes a depending skirt which extends into the area between the inner wall and the outer wall. Three static seals are provided with a first radially extending seal defined by an end of the inner wall and an inner surface of the closure. A second static seal is defined by abutting surfaces of a pair of ridges, an outwardly extending annular ridge formed on the inner wall and an inwardly extending annular ridge formed on an inner surface of the skirt. A third static seal is formed by an inwardly facing annular surface formed on the outer wall and an outwardly facing annular surface formed on an outer surface of the skirt. A fourth static seal in the form of a labyrinth seal is provided as protection against leakage from the channel. The labyrinth seal is defined by the abutment of an annular sealing surface on the outer wall and at least two outwardly extending annular ridges formed on an outer surface of the skirt.

15 Claims, 2 Drawing Sheets

TAMPER RESISTANT WIDE MOUTH PACKAGE WITH LABYRINTH SEAL

BACKGROUND OF THE INVENTION

The invention relates generally to a tamper resistant wide mouth package which readily shows any evidence of tampering and, more particularly, to a tamper resistant package which includes a container and a closure for use in collecting a sample.

The package is such that once a sample is collected in the container and the closure is attached to the container, the closure cannot be readily opened or removed from the container by anyone thereby preventing tampering, contamination or accidental spillage of the sample. Any attempt to open the package cannot be repaired. Alternatively, the tamper resistant wide mouth package of the present invention can be used in the medical, food and chemical industries.

There is now a great need for packages which are tamper resistant. Tamper resistant packages of the snap-on type have not been successfully used in the food or chemical fields or in sample collection. Rather, many packages are tamper protected with tamper indicating rings which are attached to a peripheral skirt of a closure and are torn or broken from the closure when the closure is removed. In such packages, the evidence of opening attempts is shown on the side of the package. Therefore, each package must be turned and carefully inspected by hand; which careful inspection is often neglected. The sealing provisions of each package are rather limited and the bands can be easily repaired or the closure can be opened without visible tamper evidence to the band. Further, it is known that loose pilfer bands can be repaired.

For example, U.S. Pat. No. 4,024,976 discloses a package having a tamperproofing band molded integrally with the container. The band is positioned so that it encloses at least the bottom edge of the closure cap skin when the cap is applied to the container. This requires that at least a portion of the band be removed before the cap can be removed from the container.

U.S. Pat. No. 4,027,775 discloses a container and lid having a guard flange extending about the side wall of the container immediately below and outwardly beyond the skirt of the lid. The guard flange has weakened portions which provide a removable section which may be broken away to unshield a portion of the lid skirt and permit removal of the lid.

U.S. Pat. No. 4,111,329 discloses a container having a tamperproof and stackable lid. The container has a radially extending flange which cooperates with the skirt of the cap to prevent the cap from being removed until a portion of the cap skirt is removed. The cap skirt comprises an upper portion and a lower portion with the lower portion forming a tear-off strip that is connected to the upper portion by means of vertically oriented stacking ribs. The ribs allow a plurality of caps to be stacked upon one another. The lower portion of the skirt defines an opening which enables the handler to insert a tool and then to tear the lower portion away from the upper portion of the cap skirt.

U.S. Pat. No. 4,422,559 discloses a plastic container and closure which may be repeatedly snapped together. The closure has an outer skirt and an inner concentric flange providing a channel to receive a container rim. A tear strip on the container is located adjacent the lower edge of the closure skirt in order to prevent access to the lower edge of the closure skirt without destructive removal of the tear strip.

Various other prior art tamper resistant packages only provide marginal leak protection which often results in messy spills and odors from the sample collected. Further, other prior art packages are structurally vulnerable in that side pressure in the rim area of the package often causes deformation and breaking of the pilfer band. Other problems associated with the prior art tamper resistant packages are readily known.

SUMMARY OF THE INVENTION

The present invention concerns a tamper resistant wide mouth package which is primarily suited to efficiently and conveniently administer urine sampling. Since the procedure of testing and analysis is based on mass production, there is a need to give the urine testee reasonable assurance that his or her sample is secured, confidential and not subject to mix-up or alterations. A tamper resistant design, combined with a practical testing procedure, is therefore one objective of this invention.

The tamper resistant wide mouth package of the present invention provides a convenient and fast tampering check along with leak protection seals and radial stability in order to prevent damage during shipment or testing procedures. The package includes a container having a channel-like rim profile in which a closure is sealingly engaged. The closure includes a depending skirt which fits snugly within the container channel such that the closure cannot be removed without destroying the integrity of at least a portion of the package, thereby allowing for easy observation of any tampering evidence.

Testing procedures conducted using the tamper resistant package of the present invention are both sanitary and convenient. After the sample is collected, the closure securely seals the sample within the container for safe delivery to a testing site or laboratory. The closure contains a target area which defines a scored disc for opening the package. When the scored disc is pierced by the testing personnel, an opening is defined within the closure for withdrawal of the sample contained in the container. If necessary, the opening in the closure can be resealed for storage using a plug that has a tab for easy removal to obtain access for secondary testing. Further, if necessary, for secondary sampling, again the opening in the closure can be resealed for storage using a special plug which forms a tamper resistant seal. The plug can be repierced, and a sample withdrawn from the container. Such plug can also be replaced and again tamper sealed for even tertiary sampling.

The package container according to the present invention concerns a plurality of seals. The upper end of the side wall of the container has an inner wall and an outer wall, the outer wall forming a generally U-shaped channel. A first static seal is formed by a radially extending end surface of the inner wall and an abutting radially extending inner surface of the closure. A second static seal is formed by an outwardly extending annular ridge formed on the inner wall and an inwardly extending annular ridge formed on an inside surface of the skirt. The first seal is the primary seal and the second seal is a backup seal. A third static seal is provided for the U-shaped channel. The third seal includes an inwardly facing annular sealing surface formed on the inner wall and an outwardly facing annular sealing surface formed on the skirt of the closure. During sample collection, some fluid may be collected in the channel. In addition to the third seal, a fourth static seal is provided in the form of a labyrinth seal formed by an inwardly facing annular sealing surface on the central portion of the outer wall and a plurality of outwardly extending annular ridges formed on a central section of the skirt. The second, third and fourth seals are all interference fits.

DESCRIPTION OF THE DRAWINGS

The above, as well as other objects of the invention will become readily apparent to one skilled in the art from reading the following detailed description of the preferred embodiment of the invention when considered in the light of the accompanying drawings in which.

DESCRIPTION OF THE PREFERRED EMBODIMENT

Figure 1:
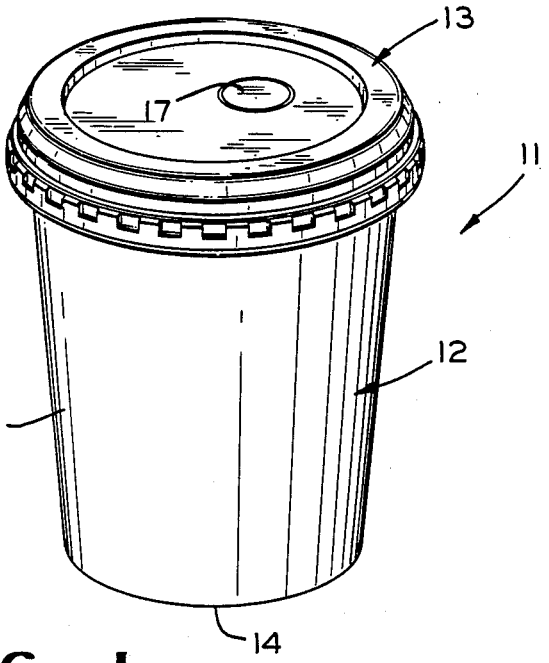
FIG. 1 is a perspective view of a tamper resistant package in accordance with the present invention.

There is shown in FIG. 1 a package 11 according to the present invention having a container 12 and a closure 13 for an open end of the container. The package 11 is of the wide mouth tamper resistant type having an easily detectable tamper resistant type having an easily detectable tamper resistant closure. While the package is primarily designed for use in collecting samples, such as in urine drug testing, the tamper resistant package of the present invention can also be used in the food and chemical industries.

The package of the present invention allows for a quick and convenient check of evidence of tampering. The test personnel, merely by glancing at the top of the package, can see signs of attempted opening without having to handle the package itself. Any attempt to open the package can not be repaired. The package of the present invention includes a container and a closure which form a plurality of seals when the container and the closure are formed together in order to prevent package leaking. The container and closure also define additional rim reinforcements which prevent tampering or breaking of the seals.

The container 12 and the closure 13 are shown as being substantially cylindrical in shape, but it should be understood that other shapes can be used without departing from the scope of the invention. The container and closure are preferably made of a pliable plastic material which will bend in thin cross section, for purposes described below, such as low or high density polyethylene, polypropylene, or a combination thereof, or blends of polyethylene and polypropylene or other suitable resins providing the desired flexibility and strength properties. The materials can be opaque, translucent, or transparent as required for different applications. The materials can further be of an FDA approved medical grade to avoid chemical leaching into the test sample which could result in altered test results. The materials can also be of a food grade, biaxially oriented, multilayered, or heatset to satisfy the food industry requirement for specific products, and with regard to barrier properties and heat stability. The container enclosure of this invention may be advantageously produced by the injection molding process of the suitable pliable plastic material. The volume of the container is defined by the capacity requirements of the test for which it is to be used, as will be explained below.

The container 12 has a closed end wall 14 closing one end of a tubular side wall 15. Opposite the closed end 14, the side wall 15 defines an open end 16 (FIGS. 2 and 3) which can be closed by the closure 13. The closure 13 includes a target area 17 where the closure is to be opened or punctured for obtaining a portion of the sample in the package. Once the closure has been opened at the target area 17, it can be resealed for storage and further testing with a special tamper resisting plug (not shown) if desired.

Figure 2:
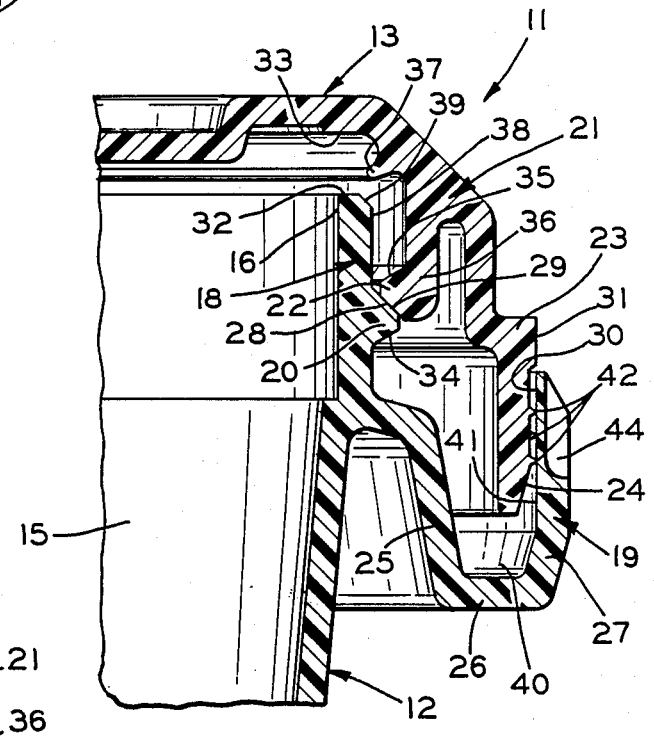
FIG. 2 is an enlarged fragmentary elevational cross-sectional view of the container and the closure of FIG. 1 at a stage in the closing of the package.
Figure 3:
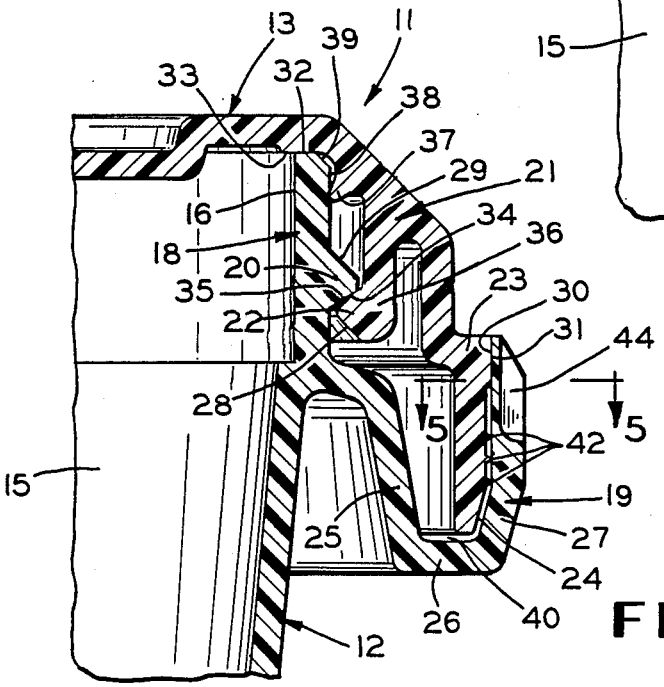
FIG. 3 is an enlarged fragmentary elevational cross-sectional view similar to FIG. 2 showing the closure and the container in the sealed position.

Referring now to FIGS. 2 and 3, a portion of the container 12 adjacent the open end 16 and an associated portion of the closure 13 are shown in cross-section. In FIG. 2, the closure 13 is shown at a first stage in the closing of the package 11. In FIG. 3, the closure 13 and the container 12 are shown in the sealed position.

The side wall 15 of the container 12 terminates at the open end 16 in an area defined by an inner wall 18 and an outer wall 19. The outer wall 19 extends radially outward and axially upward in a direction toward the open end 16. However, the outer wall 19 terminates below the open end 16. The inner wall 18 of the side wall 15 includes an engaging means or ridge 20 which extends radially outward in an area between the upper end of the outer wall 19 and the open end 16.

The closure 13 is provided with a depending annular skirt 21. The depending annular skirt 21 further includes an engaging means or ridge 22 which extends radially inward from an inner surface of the skirt toward the inner wall 18 of the container 12 for cooperation with the ridge 20. The closure 13 further includes an annular sealing member 23 formed at a lower end of the depending annular skirt 21. The annular sealing member 23 includes an angled surface 24 which extends radially outward toward the outer wall 19 of the container 12. As shown in FIG. 2, the beginning step of the sealing of the closure 13 on the container 12 is to insert the annular sealing member 23 into a U-shaped channel formed by the outer wall 19. A first portion 25 of the outer wall 19 extends radially outward and then axially downward from an outer surface of the inner wall 18. At the lower edge of the first portion 25 a second wall portion 26 extends in a radially outward direction forming the bottom wall of the U-shaped channel. The U-shaped channel is completed by a third wall portion 27 which extends axially upward from the outer edge of the second wall portion 26.

The angled surface 24 guides the depending annular skirt 21 inwardly of and down past the upper end of the third wall portion 27. The closure 13 moves downwardly until the ridge 22 engages the ridge 20. A lower surface 28 of the ridge 22 is chamfered upwardly and inwardly while an upper surface 29 of the ridge 20 is chamfered downwardly and outwardly. The angled surface 24 and the chamfers 28 and 29 are provided to help center the closure 13 on the container 12 in order to obtain a quick and proper assembly of the closure 13.

The inner diameter of the ridge 22 on the depending annular skirt 21 is slightly larger than the outer diameter defined by the ridge 20 on the inner wall 18. The chamfers 28 and 29 help to locate the two ridges such that before the closure and container are sealingly engaged, a vertical force is needed in a downward direction in order to snap the closure 13 onto the container 12. During this audible snapping procedure, an inner skirt portion 36 is flexing radially outward while the inner wall 18 is flexing radially inward.

As shown in FIG. 3, the closure 13 fits within the container 12 forming a tight interference fit between an interior surface 30 of the outer wall 19 and an exterior surface 31 of the annular sealing member 23. The surfaces 30 and 31 form a tight interference fit engagement such that these interfering surfaces are the only location where the closure 13 can be tampered with. Any tampering with the outer wall 19 can be readily seen since the outer wall is sufficiently thin such that it is quite vulnerable to damage caused by tampering. The wall 19 is slightly under tension, and any cuts would tend to spread the wall apart, making it difficult to repair. In the preferred embodiment, the outer wall 19 will be approximately 0.03 inches thick. Any damage to the outer wall 19 would be visible by looking down onto the package 11, thus allowing for a fast and convenient way of checking for tampering attempts without handling the package.

The inner wall 18 and the outer wall 19 of the sidewall 15 provide rigidity to the container 12 thus minimizing side load stress on the container caused either during shipment or by a tamper's attempt to disengage the closure 13 from the container 12. Further, the first wall portion 25, the second wall portion 26, and the third wall portion 27 define a U-shaped channel which will catch drippings of sample material thus providing a cleaner, drier filling procedure. Further, the U-shaped channel protects the depending annular skirt 21 from disengagement attempts and, at the same time, provides clearance for the depending annular skirt as it flexes radially outward during the closing procedure.

Since the filled package normally must be shipped from a testing site to a laboratory site for analysis and because rough handling during transportation is anticipated, it is important that the packages are sealed. Further, since laboratory personnel are entitled to receive clean and odor free samples in order to facilitate their work, the package of the present invention therefore provides a plurality of sealing surfaces. A first sealing surface is formed where an upwardly facing radially extending end surface 32 of the inner wall 18 engages a radially extending downwardly facing inner surface 33 of the closure 13. A second sealing surface is formed where the ridges 20 and 22 engage in the closed position shown in FIG. 3. The ridge 20 has a generally downwardly facing chamfer surface 34 which extends upwardly and outwardly from the inner wall 18. The ridge 22 has an upwardly facing chamfer surface 35 which extends downwardly and inwardly from the depending annular skirt 21. In the closed position, the surfaces 34 and 35 abut to provide a second sealing surface. In addition, the annular sealing member 23 has formed at the upper end thereof the annularly extending outwardly facing sealing surface 31. In the closed position, the sealing surface 31 abuts the inwardly facing annularly extending surface 30 formed on the third wall portion 27 to form a third sealing surface. In addition, there is pretension built into the inner wall 18 in order to provide a sealing pressure effect at the first seal 32 and 33 as well as at the second seal 34 and 35. Each seal is a static seal and works individually in order to provide the protection from leakage of the package.

In some instances, a decrease in pressure outside of the package 11 and/or an increase in pressure inside the package would have a tendency to deform or dome the closure 13 thereby breaking the seal at the abutment of the surfaces 32 and 33. Therefore, the present invention provides a dynamic seal in the form of a flexible inwardly and downwardly extending annular lip 37 formed on an inner surface of the upper end of the depending annular skirt 21. The lip 37 defines an inner diameter which is less than the diameter of an exterior annular surface 38 at the upper end of the inner wall 18. A chamfer 39 is provided between the end surface 32 and the exterior surface 38 to force the lip 37 to deform outwardly and engage the exterior surface 38 in an interference fit as shown in FIG. 3. The flexible lip 37 applies pressure against the exterior surface 38 and functions as a dynamic seal for the container 11.

The wall portions 25, 26 and 27 define a U-shaped channel 40 which has a relatively small cross-sectional area. The relatively small cross-sectional area will result in less urine being collected especially if the container is moved through the urine stream in a tilted manner. The bottom wall 26 of the channel does not horizontally join the container outer wall 18. Instead the first wall portion 25 is provided which extends upwardly and then inwardly connecting with the inner wall 18 at about the same level as the upper end of the third wall portion 27. This configuration will allow a squeezing of the container 12 without distorting the outer wall 19 which could tend to open the third seal formed by the surfaces 30 and 31 thereby creating access to the closure rim without leaving evidence of tampering. The channel 40 is not only sealed with the third seal, but a fourth static seal can be provided. An inwardly facing annular sealing surface 41 can be formed on a central portion of the third wall portion 27. A plurality of outwardly extending annular ridges 42 can be formed on a central section of the annular sealing member 23 for engaging the sealing surface 41 and forming a labyrinth fourth seal. Although three ridges 42 are shown, at least two and more than three can be provided. In addition, the ridges could be provided on the surface 41 to abut the outer surface of the annular sealing member 23.

When the ridge 22 snaps over the ridge 20 during engagement of the closure 13 with the container 12, a distinctive click or snap sound is heard. Personnel who collect a plurality of samples may tend to listen for this sound and rely upon it to determine that the closure 13 has been sealed to the open end 16 of the container 12. In order to prevent a false indication of engagement, the ridge 22 has been formed with an inner diameter which is smaller than the outer diameter defined by the exterior surface 38 of the inner wall 18. Such a configuration as well as the centering effect of the engagement of the angled surface 24 with the interior surface 30 tends to prevent the ridge 22 from snapping over the chamfer surface 39 thereby generating a false click sound.

Figure 4:
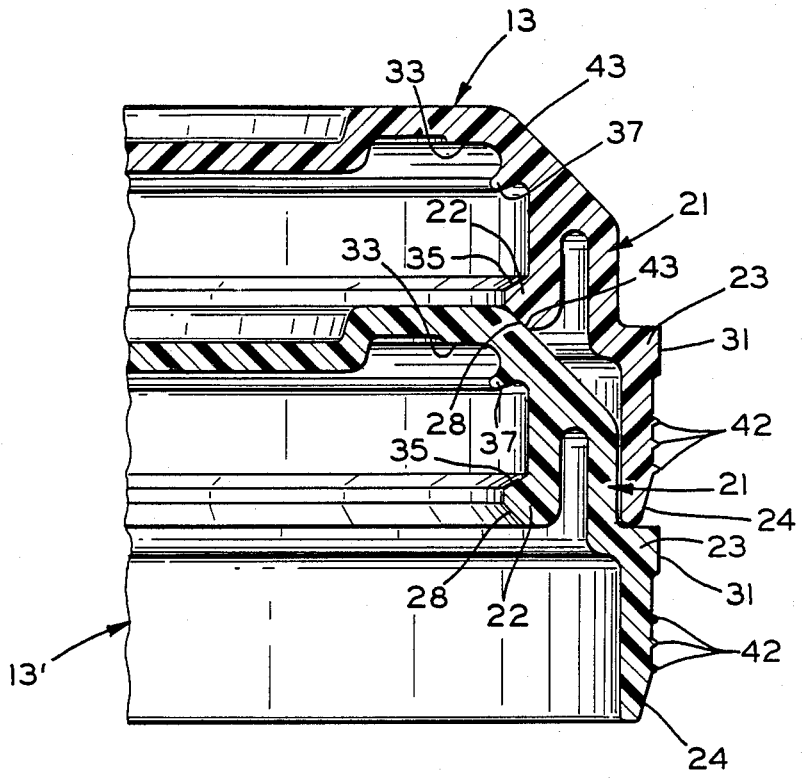
FIG. 4 is an enlarged fragmentary elevational cross-sectional view of a pair of the closures of FIG. 1 in a stacked relationship.

The closures 13 can be conveniently stacked as shown in FIG. 4. The chamfer surface 28 formed on the ridge 22 engages an upwardly facing, outwardly and downwardly extending annular surface 43 of the closure 13' below it thereby providing a stable, annular support. The other portions of each of the closures are dimensioned such that there is no interference or abutment. Thus, the closures can be easily stacked and unstacked for shipment in use.

Figure 5:
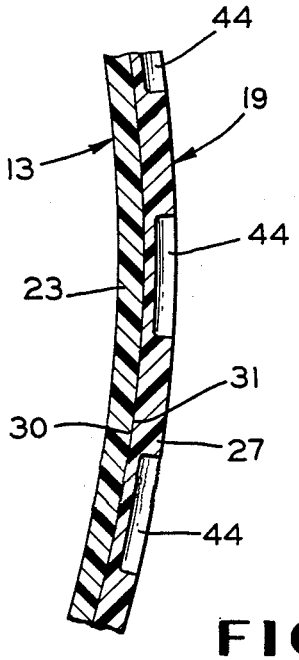
FIG. 5 is a cross-sectional view taken along the line 5—5 in FIG. 3.

FIG. 5 is an enlarged fragmentary cross-sectional view taken along the line 5—5 in FIG. 3. The third sealing surface formed by the abutment of the interior surface 30 and the exterior surface 31 extends continuously around the package 11. A plurality of indentations 44 are formed along the exterior of the upper end of the third wall portion 27 of the outer wall 19. The indentations 44 extend around the circumference of the outer wall 19 and any tampering deformation of the outer wall can be readily seen since the outer wall is sufficiently thin at the indentations 44 to render it quite vulnerable to damage caused by tampering. The third wall portion of the outer wall 19 is slightly under tension and any damage would spread the wall apart making it difficult to repair. In the preferred embodiment, a portion of the outer wall within the indentation 44 will be approximately 0.01 inches thick, rendering that thin portion frangible if tampering is attempted. As stated above, any damage to the outer wall 19 is visible by looking down onto the package 11, thus allowing for fast and convenient way of checking for tampering attempts without handling the package.

The third seal formed by the inwardly facing surface 30 and the outwardly facing surface 31 is a static seal and is the primary seal for the channel 40. As stated above, in order to provide additional protection against leakage from the package, a labyrinth seal is formed by the abutment of the inwardly facing annular sealing surface 41 and the outwardly extending annular ridges 42 to seal the channel 40.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A tamper resistant package comprising:

a container having a side wall defining an open end, a closed end wall attached to said side wall, said side wall having an inner wall and a spaced outer wall at said open end;

a closure formed of a flexible material and having a depending annular skirt adapted to securely fit between said inner wall and said outer wall of said container;

cooperating means formed on an outer surface of said inner wall and an inner surface of said closure for retaining said closure on said container; and a labyrinth seal defined by the abutment of an annular sealing surface formed on one of said outer wall and said outer surface of said skirt and at least two outwardly extending annular ridges formed on the other one of said outer wall and said outer surface of said skirt.

2. The package according to claim 1 including a static seal defined by the abutment of a radially extending sealing surface formed on said inner wall at said open end and a radially extending sealing surface formed on said inner surface of said closure.

3. The package according to claim 1 wherein said cooperating means includes a static seal defined by the abutment of a radially outwardly extending annular ridge formed on said inner wall and a radially inwardly extending annular ridge formed on said skirt.

4. The package according to claim 3 including a static seal defined by the abutment of an inwardly facing annular sealing surface formed on said outer wall and an outwardly facing annular sealing surface formed on said skirt.

5. The package according to claim 1 wherein said static seal is positioned between said labyrinth seal and said open end of said container.

6. The package according to claim 1 wherein said labyrinth seal has said annular sealing surface formed on said outer wall and a plurality of said ridges formed on said outer surface of said skirt.

7. A tamper resistant package comprising:

a container having a side wall defining an open end, a closed end wall attached to said side wall, and a radially extending sealing surface formed on said side wall at said open end;

a closure formed of a flexible material having a depending annular skirt adapted to securely fit onto said open end of said container, and a radially extending inner sealing surface for engaging said radially extending sealing surface on said container to form a first static seal;

an outwardly extending annular ridge formed on said container;

an inwardly extending annular ridge formed on said skirt, said ridges adapted to engage placing said container and closure under tension to secure said closure on said container;

said side wall having an inner wall and a spaced apart outer wall for positioning said skirt therebetween; and a labyrinth seal surface defined by the abutment of an inwardly facing annular sealing surface formed on said outer wall and at least two outwardly extending annular ridges formed on an outer surface of said skirt.

8. The package according to claim 7 wherein said outwardly extending ridge has an upwardly and outwardly facing chamfer, said inwardly extending ridge has a downwardly and outwardly facing chamfer, and said chamfers abut forming a second static seal.

9. The package according to claim 8 wherein said outer wall defines a generally U-shaped channel which protects said depending annular skirt from disengagement attempts.

10. The package according to claim 9 wherein said U-shaped channel includes a first wall portion extending outwardly and downwardly from said inner wall, a second wall portion extending generally outwardly from a lower edge of said first wall portion, and a third wall portion extending generally upwardly from an outer edge of said second wall portion.

11. The package according to claim 10 wherein said third wall portion has an inwardly facing annular sealing surface formed thereon abutting an outwardly facing annular sealing surface formed on said skirt to form a third static seal.

12. The package according to claim 11 wherein said second and third static seals and said labyrinth seal are interference fits.

13. A tamper resistant package comprising:

a container having a side wall defining an open end, a closed end wall attached to said side wall, said side wall including an inner wall and an outer wall at said open end, and said outer wall forming a generally U-shaped channel;

a closure formed of a flexible material having a depending annular skirt adapted to securely fit into said generally U-shaped channel to close said open end of said container;

a first seal formed from abutting a radially extending sealing surface on said inner wall at said open end and a radially extending inner sealing surface formed on said closure;

a second seal formed by abutting a radially outwardly extending ridge formed on an outer surface of said inner wall and a radially inwardly extending ridge formed on said depending skirt;

a third seal formed by abutting an inwardly facing annular sealing surface formed on said outer wall and an outwardly facing annular sealing surface formed on said depending skirt; and a fourth seal formed by abutting an annular sealing surface on one of said outer wall and skirt and at least two outwardly extending annular ridges formed on the other one said outer wall and said skirt.

14. The package according to claim 13 wherein said annular sealing surface of said fourth seal is on said outer wall and said ridges of said fourth seal are on said skirt.

15. The package according to claim 13 wherein said fourth seal prevents sample material in said channel from leaking from said package.

* * * * *